United States Patent [19]

Mueller

[11] 4,422,317

[45] Dec. 27, 1983

[54] APPARATUS AND PROCESS FOR SELECTIVELY EXPANDING A TUBE

[75] Inventor: Richard A. Mueller, Tulsa, Okla.

[73] Assignee: Cities Service Company, Tulsa, Okla.

[21] Appl. No.: 342,338

[22] Filed: Jan. 25, 1982

[51] Int. Cl.[3] ..... B21D 39/08

[52] U.S. Cl. ..... 72/58; 72/370

[58] Field of Search ..... 72/54, 58, 61, 62, 370; 29/421 R

[56] References Cited

U.S. PATENT DOCUMENTS 2,762,326 9/1956 Burkhart ..... 72/58
3,542,076 11/1970 Richardson ..... 72/58
4,006,619 2/1977 Anderson ..... 72/54
4,068,372 1/1978 Kornahara ..... 72/58

*Primary Examiner*—Leon Gilden
*Attorney, Agent, or Firm*—Robert H. Sproule; John W. Carpenter; George L. Rushton

[57] ABSTRACT

An apparatus and process for selectively expanding the wall of a tube by compression and subsequent radial expansion of one or more elastomeric bars lodged within longitudinal slots of a bushing positioned inside the tube. Expansion of the elastomeric bars against the inner surface of the tube results in expansion of the tube wall at intermittent locations about the circumference of the tube.

10 Claims, 6 Drawing Figures

APPARATUS AND PROCESS FOR SELECTIVELY EXPANDING A TUBE

BACKGROUND OF THE INVENTION

1. Field of the Invention

The present invention relates to an apparatus and process for expanding a tube. More particularly the apparatus and process of the present invention comprise the compression and resultant selective radial expansion of elastomeric bars against the inner surface of the tube to radially expand the walls of the tube at the locations of contact with the expanded elastomeric bars. The utility of the invention lies in its low cost tooling for complex tubular forming operations. The use of elastomeric bars allows tubular forming into a variety of shapes including elliptical, splined round, or corrugated round.

2. Description of the Prior Art

There are many methods of expanding the radius of a tube by a force located internally to the tube. Prior art methods of expanding tubes use metal rollers that move outwardly from a central position within the tube as the metal rollers are mechanically rotated about the central position. Metal rollers however can expand only to a round shape and they are limited to force applications near the free end of the tube. Other methods involve the compression and resultant expansion of high pressure fluid against the inner walls of the tube to radially expand the tube walls. Disadvantages with this method include complicated tooling involving complexly shaped seals which are prone to leakage. Other prior art such as U.S. Pat. No. 4,109,365 by Tygart involve the compression of a hard rubber or elastomer by piston forces applied from both ends of the tube, instead of one end as taught in my invention, thereby making it difficult to expand the tube at a great distance from either end of the tube.

U.S. Pat. No. 4,006,619 by Anderson discloses a tube expander utilizing hydraulically actuated pistons which compress a resilient element to radially expand a tube completely about its circumference. My invention teaches the selective expansion of a tube wall at intermittent locations about the circumference of a tube by compression and resultant expansion of elastomeric bars against the inner surface of the tube. Selective expansion may be used to form corrugated or splined tubular ends which may be useful in heat exchanger tubes to increase gas turbulence and heat transfer. Therefore, what is needed and what has been invented is an apparatus and process for selectively expanding a tube, without the foregoing deficiencies associated with prior art apparatuses.

SUMMARY OF THE INVENTION

The present invention accomplishes its desired objects by broadly providing an apparatus and process for expanding a tube. The apparatus comprises a shaft extending axially inside the tube, an inner cap bound to the shaft for longitudinal axial movement in combination with the shaft with respect to the tube, an outer cap, including at least one prong means bound thereto, slidably mounted on the shaft for longitudinal axial movement on and along the shaft with respect to the tube, and a bushing means slidably mounted on and along the shaft between the outer cap and the inner cap for longitudinal axial movement on and along the shaft with respect to the tube. An elastomeric means is slidably lodged within at least one longitudinal slot longitudinally traversing the bushing means, and the prong means is slidably lodged within the longitudinal slot of the bushing means. A means is provided for pulling the shaft in one axial direction while simultaneously pushing the outer cap in the opposite axial direction such that the inner cap contacts the bushing means and the prong means contacts the elastomeric means. The continuing respective axial forces from pulling and pushing, in combination with the prong means of the outer cap in contact with the elastomeric means within the longitudinal slot, cause the compression and resultant radial expansion of the elastomeric means at predetermined selective locations against the tube wall, subsequently resulting in selective radial expansion of the wall of the tube at intermittent locations about the circumference of the tube.

The process for expanding the wall of a tube comprises placing the shaft axially inside the tube, binding the inner cap to the shaft, mounting the bushing means, including at least one longitudinal slot longitudinally traversing the bushing means, slidably on and along the shaft, lodging the elastomeric means slidably within the longitudinal slot of the bushing means, and mounting the outer cap slidably on and along the shaft such that the bushing means is between the outer cap and inner cap. The process also includes compressing the elastomeric means between the inner cap and the prong means in order to compress and subsequently radially expand the elastomeric means at predetermined selective locations against the wall of the tube resulting in selective radial expansion of the tube wall.

It is therefore an object of the present invention to provide an apparatus and process for radially expanding a tube.

It is another object of the present invention to provide an apparatus and process for radially expanding a tube at selective locations about the circumference of the tube.

It is yet another object of the present invention to provide an apparatus and process for selectively radially expanding a tube at long distances from an open end of the tube.

These, together with various ancillary objects and features which will become apparent as the following description proceeds, are obtained by this novel apparatus and process, preferred embodiments being shown in the accompanying drawings by way of example only, wherein:

DETAILED DESCRIPTION OF THE INVENTION

Figure 1:
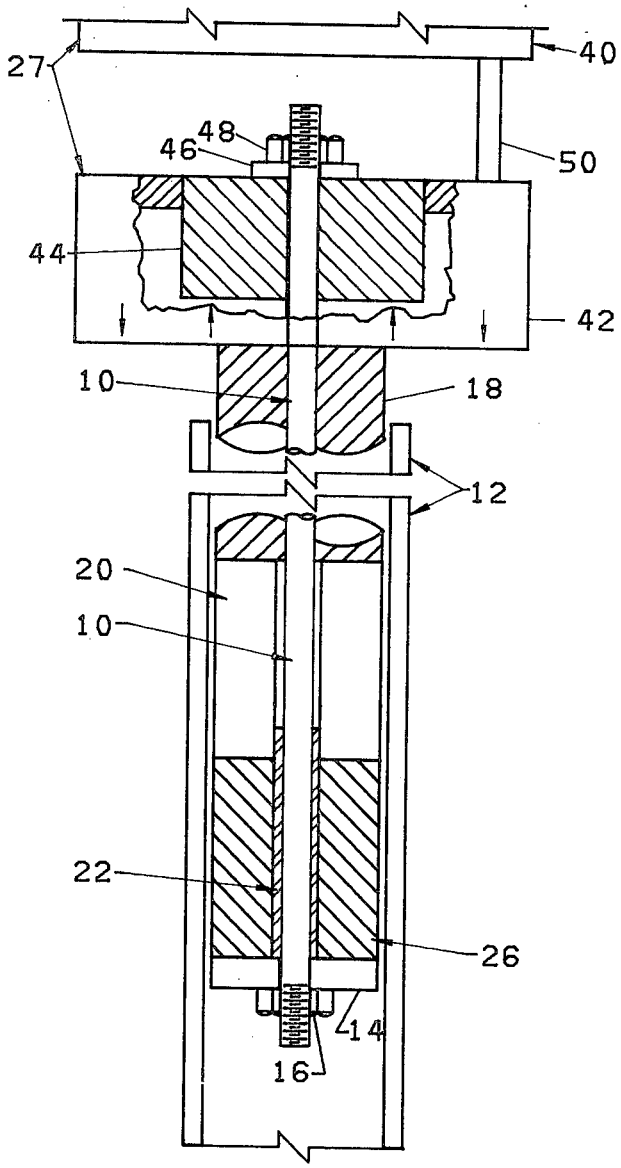
FIG. 1 is a longitudinal cross-section of the tube expander prior to expansion of the elastomeric material.

Referring in detail now to the drawings wherein like or similar parts of the invention are identified by like reference numerals, FIG. 1 defines a shaft generally illustrated as 10 axially positioned inside a tube generally illustrated as 12. Shaft 10 is generally composed of an engineering alloy such as AISI 4340 or other commercial alloy of sufficient tensile strength. The minimum diameter of shaft 10 is limited by the yield strength of the metal alloy used in its construction, but it is normally one-third the diameter of the tube. An inner cap 14 is bound by nut 16 on the threaded end of shaft 10. An outer cap 18 is mounted on shaft 10 so as to be able to slide on and along shaft 10 in a longitudinal axial direction with respect to tube 12.

Figure 2:
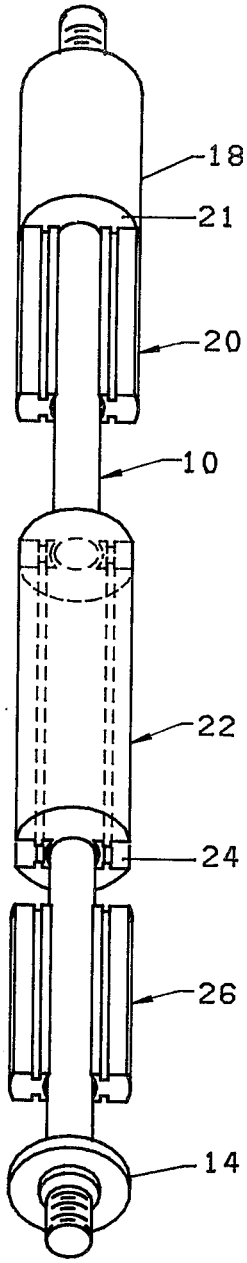
FIG. 2 is an expanded view of the tube expander fitted for selective expansion showing the slotted bushing means, elastomeric means, and outer cap with attached prong means in position relative to the shaft.

As depicted in FIG. 2, at least one prong means, generally illustrated as 20, is attached to inner face 21 of outer end cap 18. A bushing means, generally illustrated as 22, is slidably mounted on and along shaft 10 between inner cap 14 and outer cap 18 for longitudinal axial movement on and along shaft 10 with respect to tube 12. Bushing means 22 includes at least one longitudinal slot 24 which longitudinally traverses bushing means 22 and is sized to mate with prong means 20. For convenience, prong means 20 may be inserted within longitudinal slot 24 prior to placing bushing means 22 inside tube 12. Elastomeric means 26 is sized to lodge within bushing slot 24. Elastomeric means 26 may consist of any elastomer, although an elastomer having a high resilience such as hard urethane rubber is preferred. Shaft 10, outer cap 18, inner cap 14, prong means 20 and bushing means 22 may comprise any material having a strength and hardness greater than that of elastomeric means 26.

Figure 3:
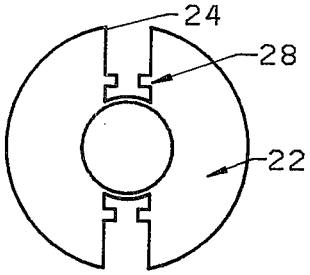
FIG. 3 is an end view of the bushing means illustrating one configuration of the apparatus having two longitudinal slots to accommodate two elastomeric bars.

As depicted in FIG. 3, a retaining means, generally illustrated as 28, comprises at least one groove longitudinally traversing the inner surface of bushing slot 24. Retaining means 28 serves to hold elastomeric bar 26 in place when elastomeric bar 26 is in a non-expanded state. Elastomeric bar 26 is sized to mate with retaining means 28 when lodged within bushing slot 24.

Figure 4:
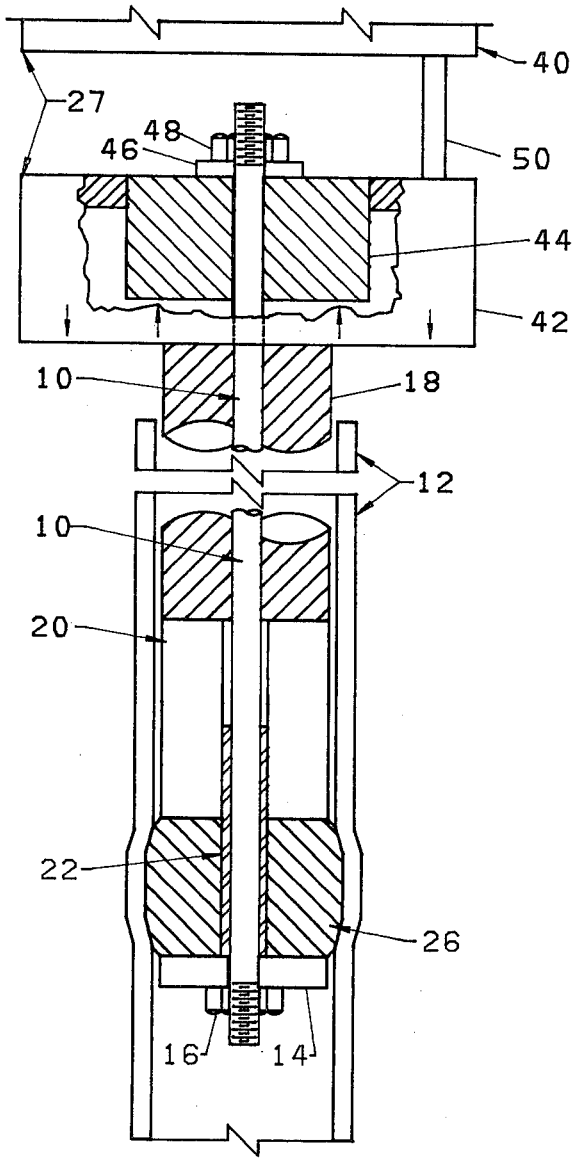
FIG. 4 is a longitudinal cross-section of the tube expander while in its expanded state inside the tube.
Figure 5:
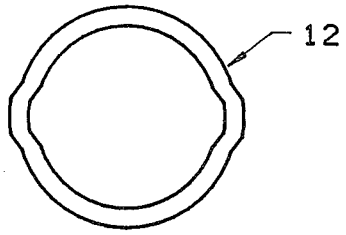
FIG. 5 is a cross-sectional end view at the area of tube expansion showing selective expansion of the tube walls by the apparatus in a two prong configuration.

The invention also comprises a means, generally illustrated as 27, for pulling shaft 10 in one axial direction, an upward direction when viewing FIG. 4, while simultaneously pushing outer cap 18 in the opposite axial direction, a downward direction when viewing FIG. 4, such that when inner cap 14 contacts bushing means 22, prong means 20 contacts elastomeric means 26. The push-pull means 27 is exemplified by hydraulic pump, generally illustrated as 40, and a combination of an outer cylinder 42 and an inner cylinder 44. Inner cylinder 44 is located inside outer cylinder 42 such that the longitudinal axes of both cylinders are concentrically aligned. Shaft 10 extends through outer cylinder 42 and inner cylinder 44 along their respective longitudinal axes. Shaft 10 is secured to inner cylinder 44 by end cap 46 and nut 48. Fluid is delivered under pressure from pump 40 through fluid conduit 50 into outer cylinder 42. The pressurized fluid acting against the inner surface of outer cylinder 42 transmits a push force through outer cap 18 to elastomeric means 22, while at the same time the fluid acting against the outer surface of inner cylinder 44 transmits a pull force through end cap 46 to shaft 10. The continuing respective axial forces from pulling and pushing, in combination with prong means 20 in contact with elastomeric means 26 within bushing means 22, compress and subsequently radially expand elastomeric means 26 at selective locations resulting in the selective radial expansion of tube 12 as depicted in FIG. 5.

When push-pull means 27 is located exterior to tube 12 as depicted in FIG. 1, outer cap 18 is sized to extend from a location in proximity to an open end of tube 12 to the point of contact with elastomeric means 26 in proximity to the area of proposed tube expansion. The distance between the open end of tube 12 and the area of proposed tube expansion however, generally may not be more than ten feet because Euler Buckling principles limit the length of outer cap 18 to approximately ten feet.

Figure 6:
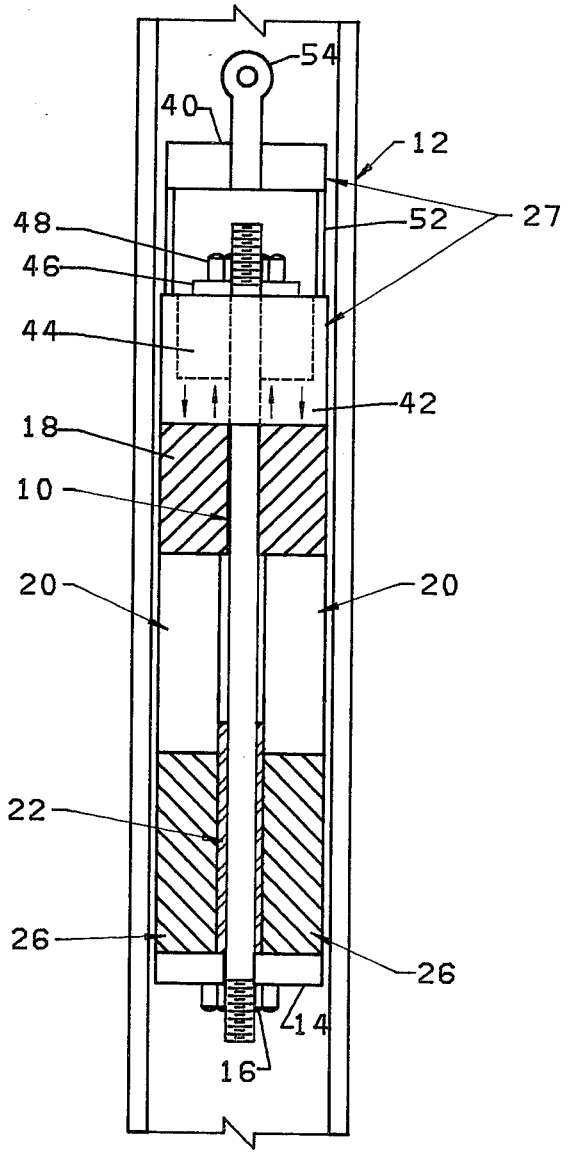
FIG. 6 is a longitudinal cross-section of the tube expander with the push/pull means located inside the tube.

When tube 12 has a diameter of approximately three inches or more, the push-pull means 27 may be located inside tube 12 as depicted in FIG. 6. Hydraulic pump 40 is rigidly attached to outer cylinder 42 by brackets 52. Brackets 52 may comprise hollow conduits for the passage of fluid under pressure from pump 40, to outer cylinder 42. A pad eye 54, mounted to pump 40, is attached to a cable (not shown in drawings) in order to lower the apparatus inside tube 12 when tube 12 is in the vertical position. The ability to place push-pull means 27 inside tube 12 allows tube expansion to be conducted at distances greater than ten thousand feet from an open end of tube 12 without the Euler buckling limitations of an elongated outer cap 18. The only limitations to placing the push-pull means 27 inside tube 12 is the length of the cable and the abillity of the cable to support the weight of the apparatus.

While the present invention has been described herein with reference to particular embodiments thereof, a latitude of modification, various changes and substitutions are intended in the foregoing disclosure, and in some instances some features of the invention will be employed without a corresponding use of other features without departing from the scope of the invention as set forth.

We claim:

1. An apparatus for radially expanding the wall of a tube at selective locations about the circumference of the tube comprising:

(a) a shaft extending axially inside the tube;

(b) an inner cap bound to the shaft for longitudinal axial movement in combination with the shaft with respect to the tube;

(c) an outer cap slidably mounted on and along the shaft for longitudinal axial movement on and along the shaft with respect to the tube, said outer cap including at least one prong means bound thereto;

(d) a bushing means slidably mounted on and along the shaft between the outer cap and the inner cap for longitudinal axial movement on and along the shaft with respect to the tube, said bushing means including a structure defining at least one longitudinal slot longitudinally traversing said bushing means, said longitudinal slot registering said prong means therein;

(e) an elastomeric means slidably lodged within the longitudinal slot of said bushing means; and (f) a means for pulling the shaft in one axial direction while simultaneously pushing the outer cap in the opposite axial direction, such that when the inner cap contacts the bushing means and the prong means contacts the elastomeric means the continuing respective axial forces from pulling and pushing, in combination with the prong means of the outer cap in contact with the elastomeric means within the longitudinal slot, compress and thereby radially expand the the elastomeric means at predetermined selective locations against the wall of said tube resulting in selective radial expansion of the tube wall.

2. The apparatus for radially expanding the wall of a tube at selective locations as recited in claim 1 wherein the outer edge of the outer cap, the outer edge of the inner cap, and the outer surface of the bushing means are sized to generally conform to the circumferential size and shape of the inner surface of the tube, and the prong means is sized to generally conform to the circumferential size and shape of the longitudinal slot of the bushing means.

3. The apparatus for radially expanding the wall of a tube at selective locations as recited in claim 2 wherein the longitudinal slot of said bushing means includes at least one retaining means longitudinally traversing the inner surface of said longitudinal slot to hold the elastomeric means within said slot.

4. The apparatus for radially expanding the wall of a tube at selective locations as recited in claim 1 wherein the means for pulling the shaft in one axial direction while simultaneously pushing the outer cap in the opposite axial direction is located inside the tube.

5. The apparatus for radially expanding the wall of a tube at selective locations as recited in claim 1 wherein the means for pulling the shaft in one axial direction while simultaneously pushing the outer cap in the opposite axial direction is located outside the tube.

6. A process for radially expanding the wall of a tube at selective locations about the circumference of the tube comprising the following steps:

(a) placing a shaft axially inside the tube, said shaft having an inner cap bound thereto for longitudinal axial movement in combination with the shaft with respect to the tube;

(b) mounting a bushing means, including at least one longitudinal slot which longitudinally traverses said bushing means, slidably on and along the shaft for longitudinal axial movement on the shaft with respect to the tube, said bushing means including an elastomeric means lodged within said longitudinal slot;

(c) mounting an outer cap, including at least one prong means bound thereto, slidably on and along the shaft for longitudinal axial movement on and along the shaft with respect to the tube, said outer cap mounted such that said elastomeric means is located between said outer cap and said inner cap, said prong means slidably lodged within said longitudinal slot;

(d) pulling the shaft in one axial direction while simultaneously pushing the outer cap in the opposite axial direction such that when the inner cap contacts the bushing means and the prong means contacts the elastomeric means the continuing respective axial forces from pulling and pushing, in combination with the prong means of the outer cap in contact with the elastomeric means within the longitudinal slot, compress and thereby radially expand the elastomeric means at predetermined selective points against the wall of said tube resulting in selective radial expansion of the tube wall.

7. The process for radially expanding the wall of a tube at selective points as recited in claim 6 additionally comprising sizing the outer edge of the outer cap, the outer edge of the inner cap, and the outer surface of the bushing means to generally conform to the circumferential size and shape of the inner wall of the tube, and sizing the prong means to generally conform to the circumferential size and shape of the longitudinal slot of the bushing means.

8. The process for radially expanding the wall of a tube at selective points as recited in claim 7 additionally comprising traversing longitudinally the inner surface of said longitudinal slot with at least one retaining means to hold the elastomeric means within said slot.

9. The process for radially expanding the wall of a tube at selective points as recited in claim 6 additionally comprising locating the means for pulling the shaft in one axial direction while simultaneously pushing the outer cap in the opposite axial direction inside the tube.

10. The process for radially expanding the wall of a tube at selective points as recited in claim 6 additionally comprising locating the means for pulling the shaft in one axial direction while simultaneously pushing the outer cap in the opposite axial direction outside the tube.

* * * * *